US007237274B2

(12) United States Patent
Cote

(10) Patent No.: US 7,237,274 B2
(45) Date of Patent: Jul. 3, 2007

(54) FOREHEAD CLEARING APPARATUS FOR HATS, CAPS AND RELATED HEADWEARS

(76) Inventor: Benoit Cote, 3268, Amis, Mascouche, Quebec (CA) J7K 1W8

( * ) Notice: Subject to any disclaimer, the term of this patent is extended or adjusted under 35 U.S.C. 154(b) by 0 days.

(21) Appl. No.: 10/827,210

(22) Filed: Apr. 20, 2004

(65) Prior Publication Data

US 2005/0229289 A1 Oct. 20, 2005

(51) Int. Cl.
*A42C 5/00* (2006.01)

(52) U.S. Cl. ..... 2/181

(58) Field of Classification Search ..... 2/181.2, 2/0.4, 0.8, 182.2, 0.5–0.7, 411, 414, 41, 183, 2/181; 34/66, 99
See application file for complete search history.

(56) References Cited

U.S. PATENT DOCUMENTS 941,717 A * 11/1909 Kolsch ..... 2/181.8
1,207,137 A 12/1916 Clore
2,417,616 A * 3/1947 Ryniker ..... 2/181.8
4,101,981 A 7/1978 Boden
4,274,157 A 6/1981 Boden
4,558,470 A * 12/1985 Mitchell et al. ..... 2/414
4,951,320 A 8/1990 Yoon
5,025,504 A * 6/1991 Benston et al. ..... 2/181.4
5,101,516 A 4/1992 Scarnato
5,317,761 A 6/1994 Piche
5,365,607 A * 11/1994 Benevento et al. ..... 2/181.4
5,495,622 A 3/1996 Kaufman
5,566,395 A 10/1996 Nebeker
5,625,901 A 5/1997 Healy
5,715,533 A 2/1998 Stein
5,956,759 A 9/1999 Benedict
5,978,969 A * 11/1999 Vinding Diers ..... 2/181.4
6,199,214 B1 * 3/2001 Campbell ..... 2/181.6

* cited by examiner

*Primary Examiner*—Katherine Moran

(57) ABSTRACT

A forehead clearing apparatus having a pair of wedge shaped modules comprising hook and pile strips wherein the pile strip has a peel and stick backing which is glued onto the headband of a hat or cap and the hook strip is permanently bonded to the wedge shaped module so that the wedge shaped modules are readily removable.

7 Claims, 3 Drawing Sheets

FOREHEAD CLEARING APPARATUS FOR HATS, CAPS AND RELATED HEADWEARS

BACKGROUND OF THE INVENTION

Field of the Invention

Figure 1:
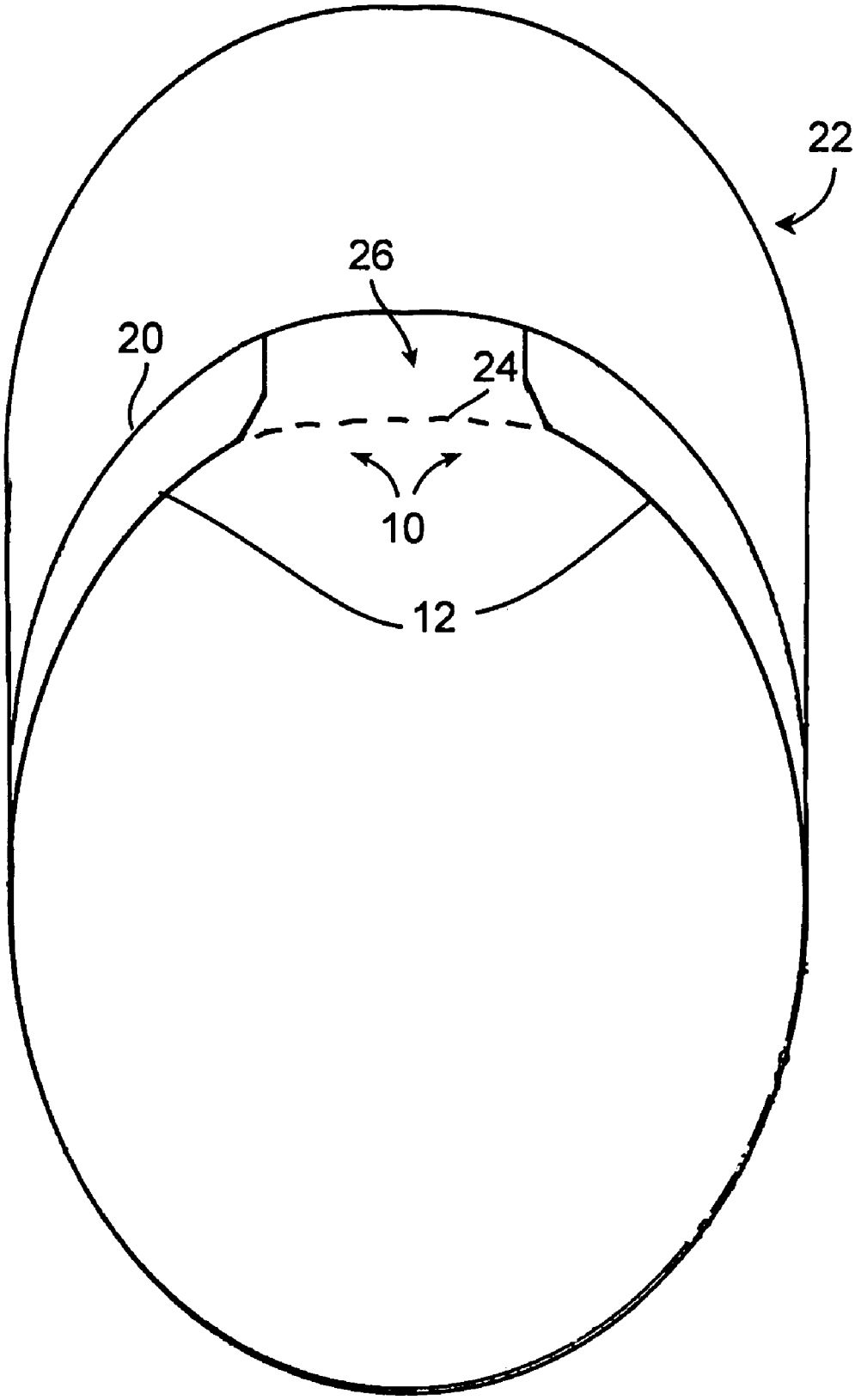

This invention relates generally to hats and caps and more particularly to a cap that keeps the forehead of a user free of contact with the cap so as to provide aeration to reduce perspiration.

Background

Although hats and caps are used to shield one's head from the harsh rays of the sun, they nonetheless create another problem which is that of added perspiration. Indeed, the lack of air circulation under the cap exacerbates the problem of perspiration. Whereas moisture from perspiration would normally evaporate, once covered, it remains trapped and tends to accumulate, drip, and create discomfort for the user.

For this reason, over the years, a number of inventors have come up with novel ways to try to solve this problem. Early in the 20th century, as bowler hats were popular, a sweat band was adapted to fit the interior perimeter of the hat.

More recently a variety of means have been used to keep the front part of a hat's band away from the user's forehead. They include pads and projecting members or spikes. Other variations concentrate on simply having an absorbent material that provides a cooling effect with evaporation. More elaborate systems include a coolant reservoir and a network of pipes to provide a cooling effect by evaporation.

One inconvenience of system which push the front part of a cap forward is that the means for pushing the front part forward is pressed against the user's forehead which does not provide adequate ventilation, although there is improved circulation inside the hat because of the spacing provided.

Other inconveniences of the prior art involve the lack of flexibility, that is, once a cap or hat has the system it is part of the cap and not made to be repeatedly removed and reinstalled which could be a desirable feature since caps are also worn when ambient temperature is cool and there is no longer a need for increased aeration, in fact quitre the opposite.

There is therefore a need for a practical and efficient means of providing aeration for a cap or hat.

SUMMARY OF THE INVENTION

It is a first object of this invention to provide for a simple and effective way of providing a cap with aeration.

It is a second object of this invention to provide for a system which can be taken out and taken in quickly.

It is a third object of this invention to provide for a system which can be installed easily and quickly inside existing hats and caps by the user without the need for tools.

It is a fourth object of this invention to provide for a system which truly clears a user's forehead with no contact whatsoever.

It is a fifth object of this invention to provide for a system which can be instantly customizable for adjusting the desired clear opening across a user's forehead according to need or preference.

In order to do so, the cap is fitted with a pair of wedge shaped modules comprising hook and pile strips wherein the pile strip has a peel and stick backing which is glued onto the headband of a hat or cap and the hook strip is permanently bonded to the wedge shaped module so that the wedge shaped modules are readily removable. The pile strips are substantially longer than the hook strips so that the wedge shaped modules can be positioned at different places along the pile strips so as to vary the distance between each of the two wedge shaped modules in order to create the desired clear space across a user's forehead. The tapered configuration of the wedge shaped modules allow for the inside rim of the hat or cap to folow the contour of a user's heasd at the back and gradually distance the rim from the head as it goes along the sides of the head until reaching the forehead where the wedge shaped modules end and the forehead clearing begins. This reduces ungainly deformation of the hat or cap.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

FIG. 1 Top cutaway view of a cap showing the wedge elements installed.

Figure 2:
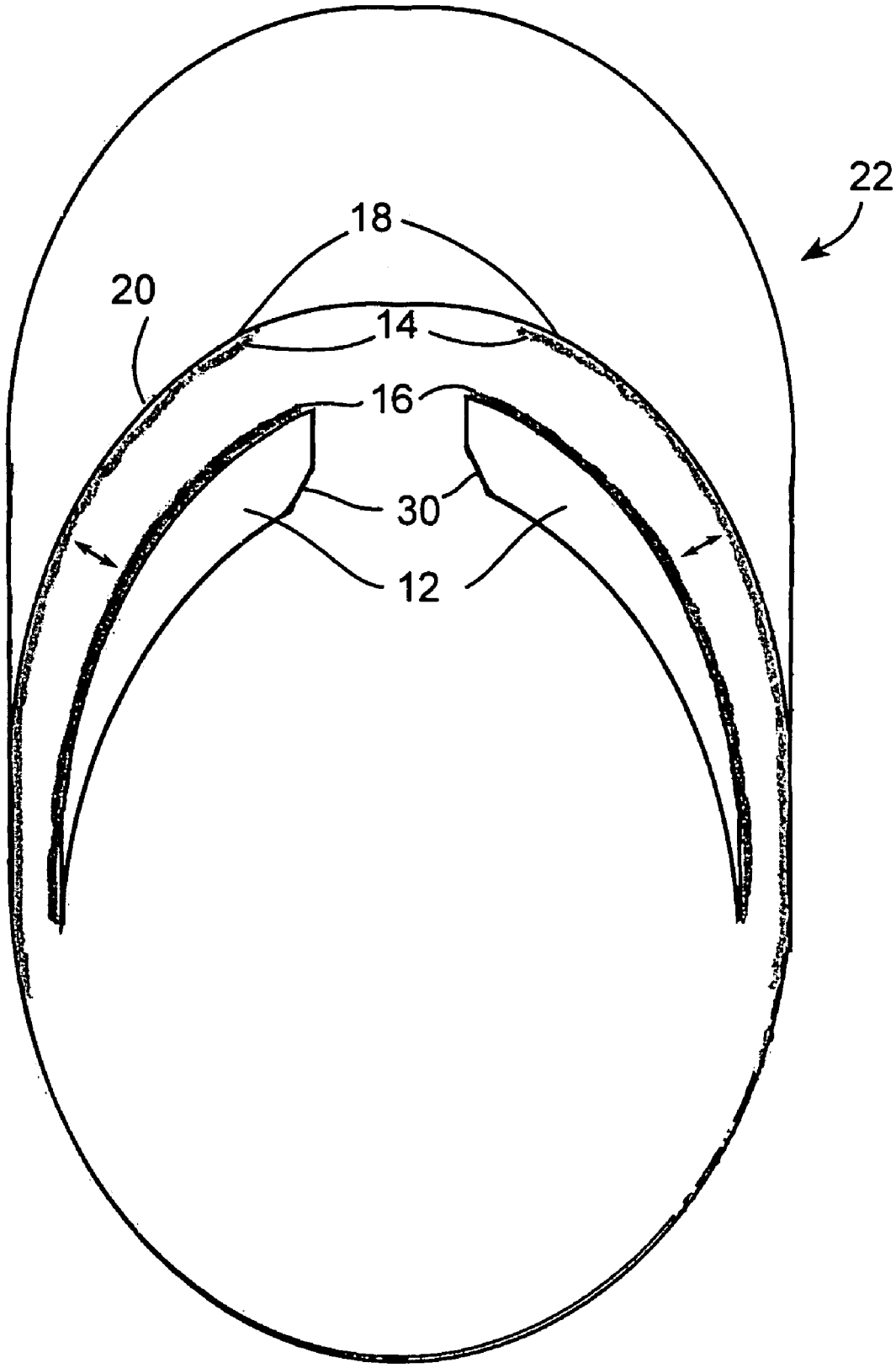

FIG. 2 Top cutaway view of a cap showing the wedge elements removed.

Figure 3:
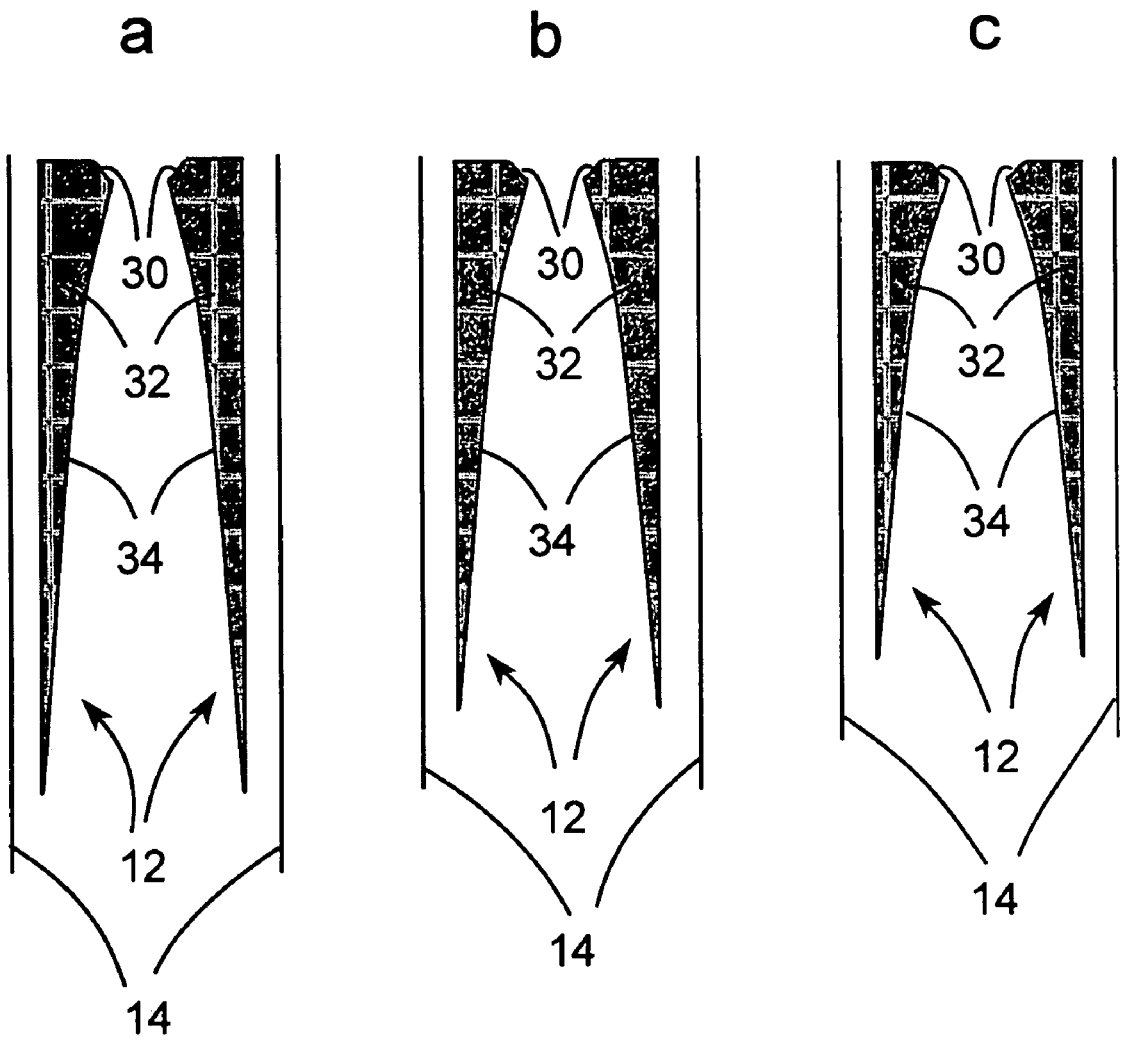

FIGS. 3*abc* Top view of various lengths of wedge elements for use on small, medium, and large heads.

DETAILED DESCRIPTION OF THE PREFERRED EMBODIMENT

A forehead clearing apparatus (10) has a pair wedge shaped modules (12) which are comprised of hook and pile strips (14, 16) wherein the pile strips (14) has a means for bonding permanently onto a headband (20) — which is a standard component on hats or caps (22) and defines the size of the hat or cap (22). One preferred means is a peel and stick backing (18) which is glued onto a headband (20). The hook strip (16) is permanently bonded to the wedge shaped module (12). By using hook and pile strips (14, 16) allows for the wedge shaped modules (12) to be readily removable (as per FIG. 2) from the headband (20). The pile strips (14) are substantially longer than the hook strips (16) so that the wedged shaped modules (12) can be positioned at different places along the pile strips (14) so as to vary the distance between each of the two wedge shaped modules (12) in order to create the desired clear space across a user's forehead (24). The tapered configuration of the wedge shaped modules (12) allow for the headband (20) of the hat or cap (22) to follow the contour of a user's head at the back and gradually distance the headband (20) from the head as it goes along the sides of the head until reaching the forehead (24) where the wedge shaped modules (12) end and the forehead clearing area (26) begins. This reduces ungainly deformation of the hat or cap (22). According to the size of the wearer, various lengths are available with the accompanying pile strip (18) preferably substantially longer. The pile side of the pile strip (14) is comfortable to the wearer when the wedge shaped modules (12) are not in use such as when the temperatures is cool. A simple adjustment of the headband (20), as found on most caps (22) can tighten the cap after the removal of the wedge shaped modules (12). Elastic bands are also used on some caps or hats (22) to provide a variable degree of flexibility in the diameter of the headband (20). To provide additional comfort, the wedge shaped modules (12) have a soft corner (30) which can be a bevel or a rounded corner which provide for a softer contact on the forehead (24). The wedge shaped modules (12) are typically made of a semi rigid, spongelike or gellike core (32) with an outer shell (34) made with a soft material. Because of their semi-rigid core (32) the wedge shaped module (12) can bend to follow the curve of the hat or cap (22) as well as of the wearer's head.

The the wedge shaped module (12) can be sold by themselves or integrated into hats or caps (22) at the manufacturing site of hats and caps (22) wherein the pile strip (14) could preferably be sewn in or glued and sewn or simply glued.

An acceptable clearing for the forehead (24) need rarely be above 5 inches wide and for children, it rarely need be narrower than 2 inches. The wedge shaped module (12) does not need to be more than about ½ inch at its thickest part and rarely more than 1 inch wide. As can be seen in the drawings, the wedge shaped module (12) are positioned lengthwise along the headband (20) and have a thick end and a thin end which defines their wedged shape. The wedge shaped modules follow the contour of a user's head from the back where the thin end of the wedge shaped module (12) is located and gradually distance the headband (20) from the head as the wedge shaped modules (12) go along the head, leading to the wedge shaped modules' thick end, reaching the forehead where the wedge shaped modules (12) end.

The invention claimed is:

1. A forehead clearing apparatus comprising:

a pair of wedge shaped modules wherein each of said pair having a length and being further comprised of a hook strip having a length;

a headband comprising a pair of pile strips having a length;

said hook strip being permanently bonded to each said module;

said pile strips being substantially longer than said hook strips such that said wedge shaped modules are positioned with their lengths extending parallel to the headband and the hook and pile strips are interlocked;

said pair of modules having a thick end and a thin end;

said wedge shaped modules follow the contours of a user's head from a back where the thin module ends are oppositely positioned, and are gradually distanced from the head as the modules extend along the head on opposite sides, towards a front forehead side.

2. A forehead clearing apparatus as in claim 1 wherein:

said wedge shaped module having a soft corner selected from a bevel or rounded corner which provide for a softer contact on said forehead.

3. A forehead clearing apparatus as in claim 1 wherein:

said wedge shaped module having a core and an outer shell.

4. A forehead clearing apparatus as in claim 3 wherein:

said core being semi rigid, and said outer shell being made of a soft material.

5. A forehead clearing apparatus as in claim 1 wherein:

said thick end positioned so as to be located adjacent a user's forehead with one said wedge shaped module for each side of said user's forehead.

6. A forehead cleaning apparatus as in claim 1 wherein:

said clearing areea for forehead being between 2 to 5 inches wide;

½ an inch at its thickest part;

no more than 1 inch wide.

7. A forehead clearing apparatus as in claim 1 wherein:

said pile strips being substantially longer than said hook strips so that said wedge shaped modules are positionable at different places along said pile strips so as to vary the distance between each of said pair of wedge shaped modules in order to create a forehead clearing area across said user's forehead.

* * * * *